US006557470B1

(12) United States Patent
Persson

(10) Patent No.: US 6,557,470 B1
(45) Date of Patent: May 6, 2003

(54) METHOD AND APPARATUS FOR CLEANING A RUBBER COATED CYLINDER IN AN OFFSET PRESS

(76) Inventor: Jan Persson, Ryttarstigen 47, Nässjo, S-571 43 (SE)

( * ) Notice: Subject to any disclaimer, the term of this patent is extended or adjusted under 35 U.S.C. 154(b) by 0 days.

(21) Appl. No.: 09/509,296

(22) PCT Filed: Sep. 23, 1998

(86) PCT No.: PCT/SE98/01705

§ 371 (c)(1),
(2), (4) Date: Apr. 21, 2000

(87) PCT Pub. No.: WO99/15335

PCT Pub. Date: Apr. 1, 1999

(30) Foreign Application Priority Data

Sep. 24, 1997 (SE) ..... 9703440

(51) Int. Cl.[7] ..... B41L 41/00
(52) U.S. Cl. ..... 101/424; 101/425
(58) Field of Search ..... 101/424, 425, 101/483, 423; 15/256.5, 256.51, 256.52

(56) References Cited

U.S. PATENT DOCUMENTS

| | | | | |
|---|---|---|---|---|
| 4,236,450 A | * | 12/1980 | Bonomi | 101/425 |
| 4,393,778 A | | 7/1983 | Kaneko | 101/425 |
| 4,875,412 A | * | 10/1989 | Wright et al. | 101/425 |
| 4,967,664 A | * | 11/1990 | Iijima | 101/423 |
| 5,038,680 A | * | 8/1991 | Bain | 101/401.1 |
| 5,046,416 A | * | 9/1991 | Freyer et al. | 101/148 |
| 5,213,044 A | * | 5/1993 | Elia et al. | 101/483 |
| 5,255,606 A | * | 10/1993 | Iijima et al. | 101/423 |
| 5,265,537 A | * | 11/1993 | Gasparrini et al. | 101/425 |
| 5,303,652 A | | 4/1994 | Gasparrini et al. | 101/425 |
| 5,575,211 A | * | 11/1996 | Harrison | 101/423 |
| 6,116,161 A | * | 9/2000 | Voge et al. | 101/423 |

FOREIGN PATENT DOCUMENTS

| | | |
|---|---|---|
| DE | 2159115 | 6/1972 |
| DE | 43 30 257 | 3/1995 |
| DE | 195 20 551 | 12/1996 |
| DK | 170148 | 6/1995 |
| SE | 417 298 | 3/1981 |

* cited by examiner

*Primary Examiner*—Anthony H. Nguyen
(74) *Attorney, Agent, or Firm*—Merchant & Gould, P.C.

(57) ABSTRACT

Method and apparatus for cleaning a rubber coated cylinder (10) mounted in an offset printing machine for transferring the print from a printing plate cylinder (11) to a paper web (12) running in contact with the rubber coated cylinder, while the offset printing machine is running. The surface of the rubber coated cylinder is brushed by means of a brush (16) which extends in parallel with the cylinder and has substantially the length thereof and which is engaged with the rubber coating and imparted an axially reciprocating movement for loosening the contaminants and distribution thereof over the surface of the cylinder. Washing liquid is sprayed onto the surface of the rubber coated cylinder from a ramp (14) mounted in parallel with the cylinder and having a number of spray nozzles distributed along the ramp for dissolving the contaminants. Washing liquid and contaminants are removed from the surface of the cylinder by means of the paper web running through the offset printing machine.

5 Claims, 1 Drawing Sheet

METHOD AND APPARATUS FOR CLEANING A RUBBER COATED CYLINDER IN AN OFFSET PRESS

Figure 1:
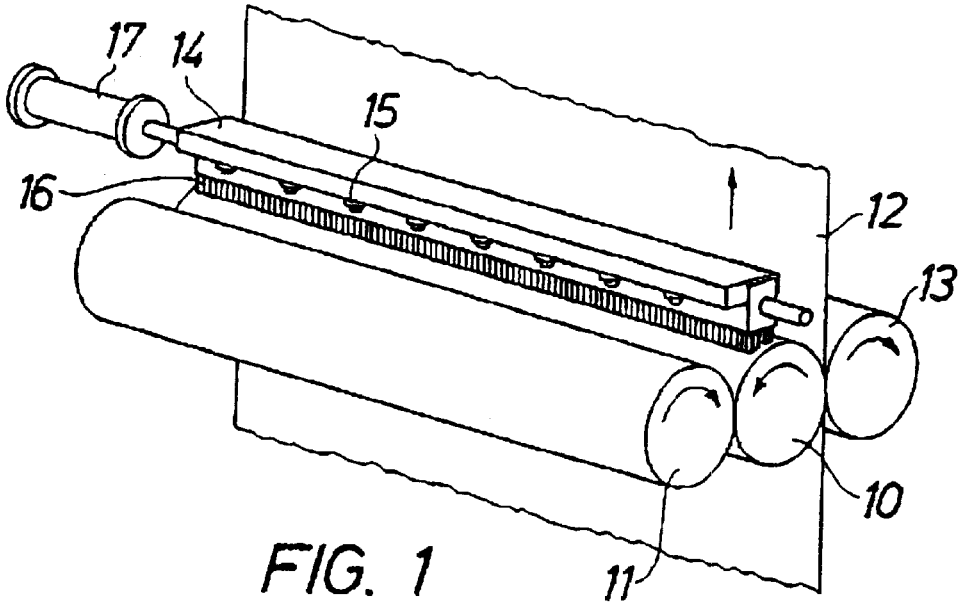

The invention relates to method and apparatus for cleaning a rubber coated cylinder mounted in an offset printing machine for transferring the print from a printing plate cylinder to a paper web running in contact with the rubber coated cylinder while the offset printing machine is running.

During printing the rubber coated cylinder will be contaminated by ink residues, paper dust, and paper fibers being deposited on and adhering to said cylinder, and as a consequence thereof it is necessary to clean the surface of the cylinder at regular intervals in order to maintain the quality of the print. The cleaning is effected by using a washing liquid (detergent, solvent, water, or a mixture thereof) and can be effected manually when the offset printing machine is not running, which, of course, means production lose. This can be avoided by manual cleaning while the offset printing machine is running, which also is practised but is dangerous due to the high rotational speed of the cylinder. Therefore, automatic systems have been proposed which at intervals clean the rubber coated cylinder while the offset printing machine is running. One method is to spray the cylinder with washing liquid in order to dissolve and wash off the contaminants, which means that large amounts of inflammable washing liquid that is not at all pro-environmental has to be handled in order to completely clean the cylinder, which is not satisfactory. Such a prior art cleaning system is disclosed in U.S. Pat. No. 5,303,652 and comprises a ramp mounted in parallel with the cylinder and having a number of spray nozzles distributed along the ramp for sprinkling the surface of the rubber coated cylinder with cleaning liquid under the rotation of the cylinder.

According to another prior art method, DE-A1 43 30 257, a rotating brush contacting the rubber coated cylinder is used, the rotational axis of said brush being parallel with the rotational axis of the cylinder. The brush is moistened with washing liquid. In order to avoid too hard wear of the rubber coating an effective cleaning of the cylinder at the same time being achieved, the cylinder then is wiped off by means of a cloth impregnated with washing liquid. The system is complicated with respect to construction as well as function.

The object of the invention is to provide an effective cleaning of the rubber coated cylinder while the offset printing machine is running, a reduced amount of washing liquid due to the fact that the contaminants are not washed off the cylinder but are brushed loose under gentle mechanical treatment of the rubber coating in order to loosen also firmly adhering contaminants, the washing liquid and the contaminants then being removed by means of the running paper web.

According to the invention said object is achieved by the method according to claim 1. The invention also relates to an apparatus for working the method according to claim 2.

While the off set printing machine is running and the rubber coated cylinder thus is rotating with the paper web running over the cylinder the contaminants on the cylinder are loosened and distributed by means of the reciprocating brush and are dissolved by means of the sprinkled washing liquid the contaminants together with the washing liquid being carried along by the rotating cylinder and removed in known manner from the offset printing machine by means of the paper web passing through the machine and bringing along washing liquid and contaminants from the cylinder at contact therewith.

The cleaning will be particularly effective if the brush comprises two sections located one behind the other in respect of the rotational direction of the cylinder, the first section loosening contaminants and the other section scraping loose such material as has not been removed in the first step, and distributing the contaminants over the surface of the cylinder.

Figure 2:
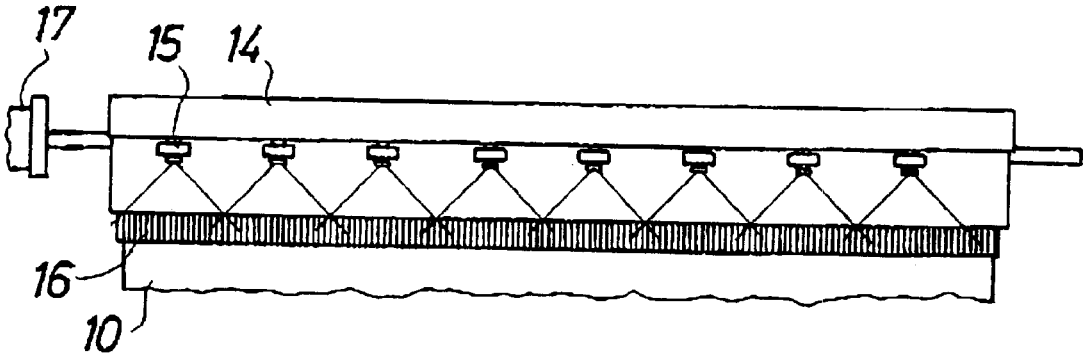
Figure 3:
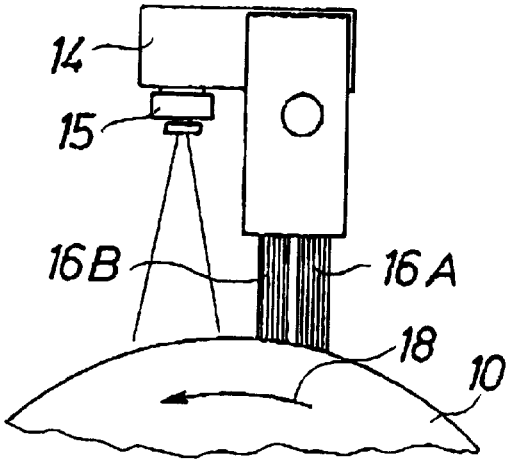

In order to explain the invention in more detail an embodiment thereof will be described with reference to the accompanying drawing in which FIG. 1 is a perspective view of the apparatus according to the invention, FIG. 2 is an enlarged front view of the nozzle ramp and the brush included in the apparatus, and FIG. 3 is an end view of the nozzle ramp and the brush.

A cylinder 10 which is coated with rubber cloth or is rubber coated in another way forms part of an offset printing machine and the purpose thereof is to transfer the print from the a printing plate cylinder 11 contacting the cylinder 10, to a paper web 12 which is advanced between the cylinder 10 and a back pressure cylinder 13. A ramp 14 is mounted above the cylinder 10 in parallel therewith comprising as a metal sheet housing on which a number of spray nozzles 15 for washing liquid are provided the washing liquid being sprayed towards the surface of the cylinder 10 by means of the nozzles over the total length of the cylinder. Inside the metal sheet housing a brush 16 is mounted which comprises two sections 16A and 16B extending in parallel along the cylinder 10 The brush is guided in the metal sheet housing for reciprocating movement in the longitudinal direction of the cylinder and in order to provide this movement the brush is connected to a pneumatic ram 17. The stroke of the brush is short and can be e.g. 30 mm. The ramp 14 in its entirety can be raised and lowered in the frame of the offset printing machine in a manner not shown herein so that the brush 16 in a raised position is spaced from the cylinder 10, which is the position of the ramp during normal operation of the offset printing machine, and in a lowered position is in contact with the cylinder 10.

When the offset printing machine has been running over a certain period for printing, web contaminants such as ink residues, paper dust and paper fibers have collected on the surface of the rubber coated cylinder the print on the paper web 12 consequently being deteriorated. Then, it is necessary to clean the cylinder and remove said contaminants therefrom. The printing plate cylinder 11 is brought out of contact with the cylinder 10, and the ramp 14 which is raised during normal operation of the offset printing machine is then lowered such that the brush 16 will contact the surface of the cylinder 10 as shown in the drawing. This takes place without the necessity of stopping the offset printing machine. Washing liquid is sprayed onto the rotating cylinder 10 over the total axial length thereof from the nozzles 15 downstream of the brush 16 in respect of the rotational direction of the cylinder 10, which is indicated by an arrow 18 in FIG. 3. The brush is brought into reciprocating movement in the longitudinal direction of the cylinder 10 by means of the pneumatic ram 17. Contaminants on the cylinder 10 are loosened from the surface of the cylinder by means of the brush section 16A in order then to be distributed over the surface of the cylinder by means of the brush section 16B which also scrapes loose contaminants which the brush section 16A has not been able to loosen. The washing liquid which comprises a suitable solvent for the ink residues dissolves the contaminants on the cylinder 10 the washing liquid and the dissolved contaminants being retained on the cylinder 10 due to the fact that the cylinder is charged with static electricity. By the rotation of the cylinder 10 being brought into contact with the paper web 12 and adhere to the web due to the existence of a more powerful charge of static electricity on the paper web. Rubbing between the rubber coating on the cylinder 10 and the paper web 12 and between the cylinder 10 and the printing plate cylinder 11 running in contact with cylinder 10 generates static electricity in the cylinder 10. The charging of the paper web 12 with static electricity is caused by friction in the paper roll from which the paper web 12 is withdrawn and also by rubbing against existing cylinders (not shown) over which the paper web is passing before arriving at the nip between the cylinders 10 and 13. By contact with the cylinder 10 the paper web attracts washing liquid and dissolved contaminants existing on the surface of the cylinder 10. Liquid and contaminants are removed by the paper web which, of course, forms wastepaper as long as the cleaning is going on. The ramp 14 is lifted from the cylinder 10 when the cleaning has been finished, and spraying with washing liquid is shut off as well as the reciprocating movement of the brush 16. The printing plate cylinder 11 is engaged with the cylinder 10 in order to continue the printing operation in the offset printing machine which has been kept running continuously during the total cleaning procedure which can take place without manual attendance.

What is claimed is:

1. An apparatus for cleaning a rubber coated cylinder mounted in an offset printing machine for transferring a print from a printing plate cylinder to a paper web running in contact with the rubber coated cylinder, the apparatus comprising:

a ramp mounted in parallel with the rubber coated cylinder;

reciprocating means for reciprocating the ramp in an axial direction of the rubber coated cylinder;

a brush on the ramp that extends along the ramp and that has substantially the length thereof to be engaged with a surface of the rubber coated cylinder; and a number of spray nozzles for supplying cleaning liquid, the spray nozzles being distributed along the ramp after the brush as seen in a rotational direction of the rubber coated cylinder for spraying a surface thereof with cleaning liquid during rotation of said rubber coated cylinder.

2. The apparatus of claim 1, wherein the brush comprises two sections that are positioned one behind the other in the rotational direction of the rubber coated cylinder.

3. The apparatus of claim 1, wherein the brush has a stroke of about 30 mm.

4. The apparatus of claim 2, wherein the brush has a stroke of about 30 mm.

5. An apparatus for cleaning a rubber coated cylinder mounted for rotation in an offset printing machine, the rubber coated cylinder having an outer surface that is engageable with a printing plate cylinder for transferring ink from the printing plate cylinder to a paper web imputing in contact with the outer surface of the rubber coated cylinder the apparatus comprising:

a ramp mounted parallel to the rubber coated cylinder;

a reciprocating mechanism for reciprocating the ramp in a direction parallel to the rubber coated cylinder;

a brush on the ramp that extends along the length of the ramp so as to be engageable with the outer surface of the rubber coated cylinder at a first location during rotation of the rubber coated cylinder, and a plurality of spray nozzles distributed along the length of the ramp after the brush as seen in the rotational direction of the rubber coated cylinder for sprinkling cleaning liquid onto the outer surface of the rubber coated cylinder at a second location.

* * * * *